US009913514B2

(12) United States Patent
Choi

(10) Patent No.: US 9,913,514 B2
(45) **Date of Patent: *Mar. 13, 2018**

(54) BRILLIANCE ENHANCING JEWELRY PRONG SETTING

(71) Applicant: FD Worldwide Merchandise Group, Inc., New York, NY (US)

(72) Inventor: Sheung S. Choi, Roslyn, NY (US)

(73) Assignee: FD Worldwide Merchandise Group, Inc. NY (US)

( * ) Notice: Subject to any disclaimer, the term of this patent is extended or adjusted under 35 U.S.C. 154(b) by 356 days.

This patent is subject to a terminal disclaimer.

(21) Appl. No.: 14/635,328

(22) Filed: Mar. 2, 2015

(65) Prior Publication Data

US 2015/0173470 A1 Jun. 25, 2015

Related U.S. Application Data

(63) Continuation of application No. 12/661,051, filed on Mar. 9, 2010, now Pat. No. 8,966,938.

(51) Int. Cl.
*A44C 17/02* (2006.01)
*A44C 9/00* (2006.01)

(52) U.S. Cl.
CPC ..... *A44C 17/02* (2013.01); *A44C 9/00* (2013.01)

(58) Field of Classification Search
CPC ..... A44C 17/02; A44C 9/00
USPC ..... 63/15, 26–28; D11/34, 91, 92
See application file for complete search history.

(56) References Cited

U.S. PATENT DOCUMENTS

| | | | | | |
|---|---|---|---|---|---|
| 665,089 | A | * | 1/1901 | Greenberg | A44C 17/02 63/15 |
| D68,641 | S | * | 11/1925 | Robbins | D11/34 |
| D259,031 | S | * | 4/1981 | Barr | D11/34 |
| 4,392,289 | A | * | 7/1983 | Michaud | A44C 17/046 164/10 |
| 5,398,525 | A | * | 3/1995 | Kennedy | A44C 17/02 63/26 |
| D388,015 | S | * | 12/1997 | Itzkowitz | D11/90 |
| D415,062 | S | * | 10/1999 | Wolf | D11/90 |
| D421,930 | S | * | 3/2000 | Wolf | D11/90 |
| D445,058 | S | * | 7/2001 | Kaplan | D11/91 |
| D446,151 | S | * | 8/2001 | Siebenberg | D11/90 |
| D450,617 | S | * | 11/2001 | Wolf | D11/90 |
| D453,908 | S | * | 2/2002 | Kaplan | D11/91 |
| D454,090 | S | * | 3/2002 | Kaplan | D11/91 |
| D544,809 | S | * | 6/2007 | Shah | D11/91 |
| D647,817 | S | * | 11/2011 | Kothari | D11/40 |

* cited by examiner

*Primary Examiner* — Jack W Lavinder
(74) *Attorney, Agent, or Firm* — Feldman Law Group, P.C.; Steven M. Crosby

(57) ABSTRACT

A ring includes a head portion, a base portion and a structure. The structure is incorporated into a first thickness of the head portion with the structure being between an inner rim and an outer rim of the head portion. The structure includes an invisible setting located within an indentation of the structure with the invisible setting mounting at least one center stone and a plurality of secondary stones in such a way that the at least one center stone and the plurality of secondary stones appear to be a continuous, uninterrupted surface thereby creating an illusion of a large stone in a marquise or round shape.

2 Claims, 8 Drawing Sheets

BRILLIANCE ENHANCING JEWELRY PRONG SETTING

CROSS-REFERENCE TO RELATED APPLICATION

This application is a continuation of U.S. patent application Ser. No. 12/661,051, filed on Mar. 9, 2010, now pending, which patent application is incorporated here by reference in its entirety to provide continuity of disclosure.

FIELD OF THE INVENTION

The present invention relates to brilliance enhancing jewelry devices and, more particularly, to a prong setting adapted to help enhance brilliance and sparkle of a central stone set in the prong setting.

BACKGROUND

The jewelry settings are normally provided with prongs that are widely used in the art to hold the diamonds within the settings. For example, U.S. Pat. No. D 315,698 shows a setting wherein the princess-cut diamond is held in place by the use of plurality of prongs. Moreover, the use of prong settings for setting multiple stones for creating an illusion of a big diamond is seen in prior art U.S. Pub. Nos. 2005/0144980 and 2007/0234758. However, the diamonds of these settings frequently come out as they undergo physical deterioration due to their outward configuration and orientation. In addition, the jewelry prongs are normally positioned over the upper surfaces of the diamonds and are especially adapted to at least partially enclose the upper surface of the diamonds that reduces the aesthetic effect of the diamonds as well.

The use of invisible mounting techniques to overcome the problems associated with the prong settings is well known in the art, wherein the diamonds are mounted on the settings without the use of the prongs. One such example of the mounting technique is channel setting. For example, U.S. Pub. No. 2008/0053148 shows one such setting that provides an invisible or mysterious setting system that has the particular feature of allowing several round precious stones of predefined shape to be assembled around a central round precious stone in such a way as entirely to eliminate grooves on the table side of the precious stones to result is an attractive appearance which gives the illusion of one large round precious stone when the stone is viewed from the table side. Moreover, U.S. Pat. No. 6,550,275 discloses a round gemstone setting with convexly configured gemstones that are set in flush, surface to surface mating relation. However, designing of the invisible settings using single shaped diamond can be a very difficult task especially for relatively larger and complex shaped diamonds, such as Marquise or Pear shaped diamonds. Such settings need substantial designing efforts from the designer/artisan with single shaped/cut diamonds and unnecessarily increase the effective cost of the jewelry article. Hence, the utilization of multi-shaped diamonds for forming marquise or pear shaped composite Diamond Head is needed.

There are few attempts seen in the art to use a plurality smaller diamonds to form a composite Diamond Head in order to reduce the effective cost and efforts being utilized. One such head can be seen in the prior art U.S. Pub. No. 2005/0188722 that discloses an exemplary system and method for providing a jewelry setting is disclosed that comprises a first gemstone in an array of gemstones generally retained at a girdle by fasteners that hold the a plurality of gemstones surrounding the first gemstone. Also, the prior art U.S. Pat. No. D 505,092 teaches an ornamental design for a diamond setting wherein the setting comprises total eleven diamonds that all are of round shape. However, the settings in the art have substantially failed to use multi-shaped diamonds/stones as the diamonds from the settings are generally of single shape. Hence, the utilization of multi-shaped diamonds such as, for example, smaller round, medium round, large round, princess and baguette stones to form a composite diamond head is needed.

SUMMARY OF THE INVENTION

A ring with a composite Diamond Head setting is described that comprises an inner rim member and an outer rim member that are adapted to define a head portion and a base portion of the ring. The inner and outer rim members of the ring have an off-centered orientation to facilitate the head portion to have a larger thickness than the base portion wherein the inner rim defines a circular boundary of hollow space within the ring adapted to define a finger size of the ring.

The head portion includes a first channel structure that includes an indentation that is adapted to be positioned with a plurality of multiple shaped diamonds through an invisible setting means in a juxtaposition arrangement to form a clustered Diamond Head that creates an illusion of a big diamond to a normal observer. The indentation of the first channel structure preferably has a marquise shape and includes three princess-cut diamonds and ten baguette diamonds in a juxtaposition arrangement to form a clustered Diamond Head that creates an illusion of a big marquise shape diamond.

The marquise shaped indentation can include four princess-cut diamonds and six round-cut diamonds in a juxtaposition arrangement to form a clustered Diamond Head that creates an illusion of a big marquise shape diamond. The marquise shaped indentation can include three princess-cut diamonds, four larger round-cut diamonds and two smaller round-cut diamonds in a juxtaposition arrangement to form a clustered Diamond Head that creates an illusion of a big marquise shape diamond. The marquise shaped indentation can include three princess-cut diamonds, eight baguette-cut diamonds, and two half round-cut diamonds in a juxtaposition arrangement to form a clustered Diamond Head that creates an illusion of a big marquise shape diamond. The marquise shaped indentation can include four princess-cut, six large round-cut diamonds and six small round-cut diamonds in a juxtaposition arrangement to form a clustered Diamond Head that creates an illusion of a big marquise shape diamond.

The indentation can be of circular shape adapted to include one princess-cut diamond, four large round-cut diamonds and four small round-cut diamonds in a juxtaposition arrangement to form a clustered Diamond Head that creates an illusion of a big circular shape diamond. The indentation can be of a pear shape adapted to include three princess-cut diamonds, two large round-cut diamonds, two medium round-cut diamonds and four small round-cut diamonds in a juxtaposition arrangement to form a clustered Diamond Head that creates an illusion of a big pear shape diamond.

The head portion also includes a second channel structure aligned along a first side edge of the head portion that is configured to be mounted with a row of round diamonds/stones in a juxtaposition arrangement to represent a continuous uninterrupted diamond surface along the first side edge of the head portion. The head portion also includes a third channel structure aligned along a second side edge of the head portion that is configured to be mounted with a plurality of round diamonds/stones in a row and juxtaposition arrangement to represent a continuous uninterrupted diamond surface along the second side edge of the head portion. The head portion includes a fourth channel structure adapted to be mounted with a plurality of baguette diamonds in a row and juxtaposition arrangement to represent a continuous uninterrupted diamond surface along a center of the head portion. The head portion also includes a first and second pair of baguette diamonds adapted to be positioned on the head portion using prong setting means.

BRIEF DESCRIPTION OF DRAWINGS

The above mentioned and other features, aspects and advantages of the present invention will become better understood with regard to following description, appended claims and accompanying drawings, wherein like reference numerals refer to similar parts throughout the several views where:

DETAILED DESCRIPTION

Figure 1:
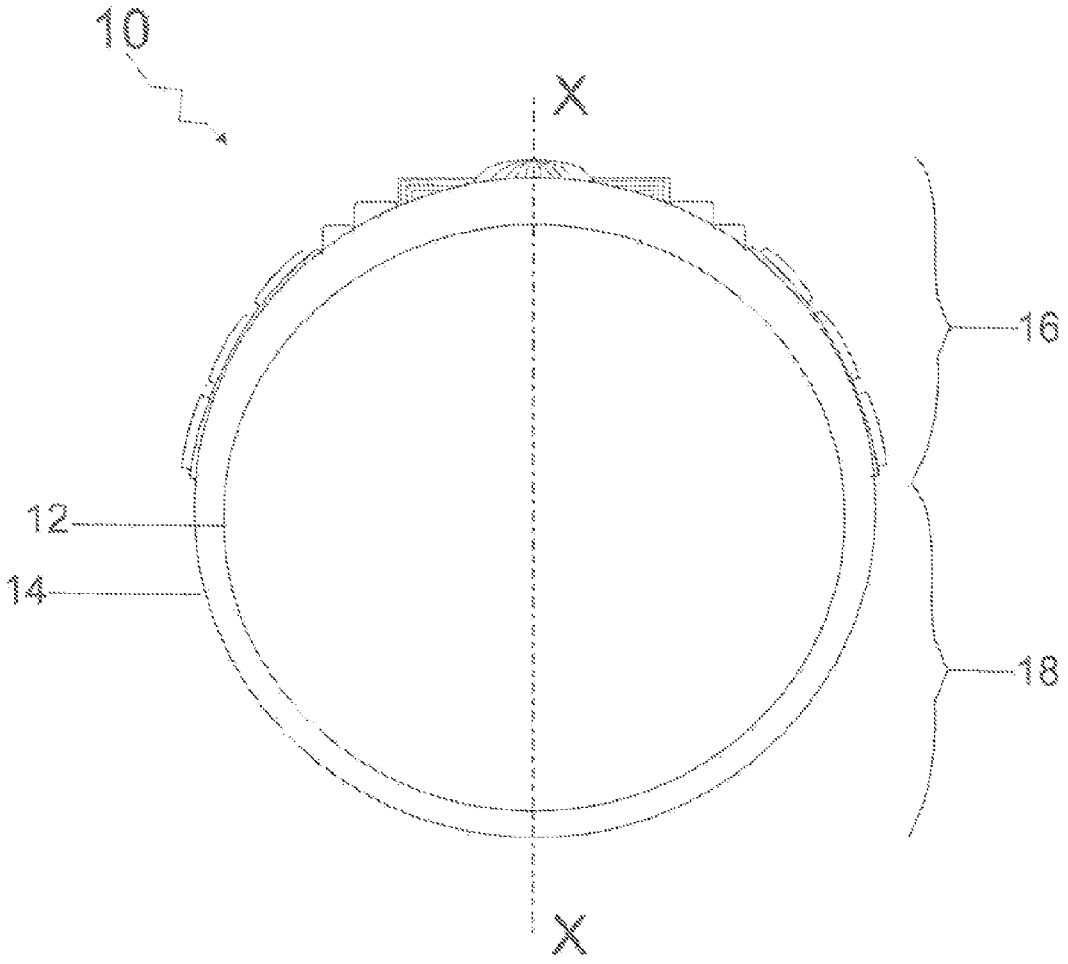
FIG. 1 is a front view of a ring with a first preferred embodiment of a composite diamond head ring setting constructed in accordance with the present invention.

Although specific terms are used in the following description for sake of clarity, these terms are intended to refer only to particular structure of the invention selected for illustration in the drawings, and are not intended to define or limit the scope of the invention.

Figure 2:
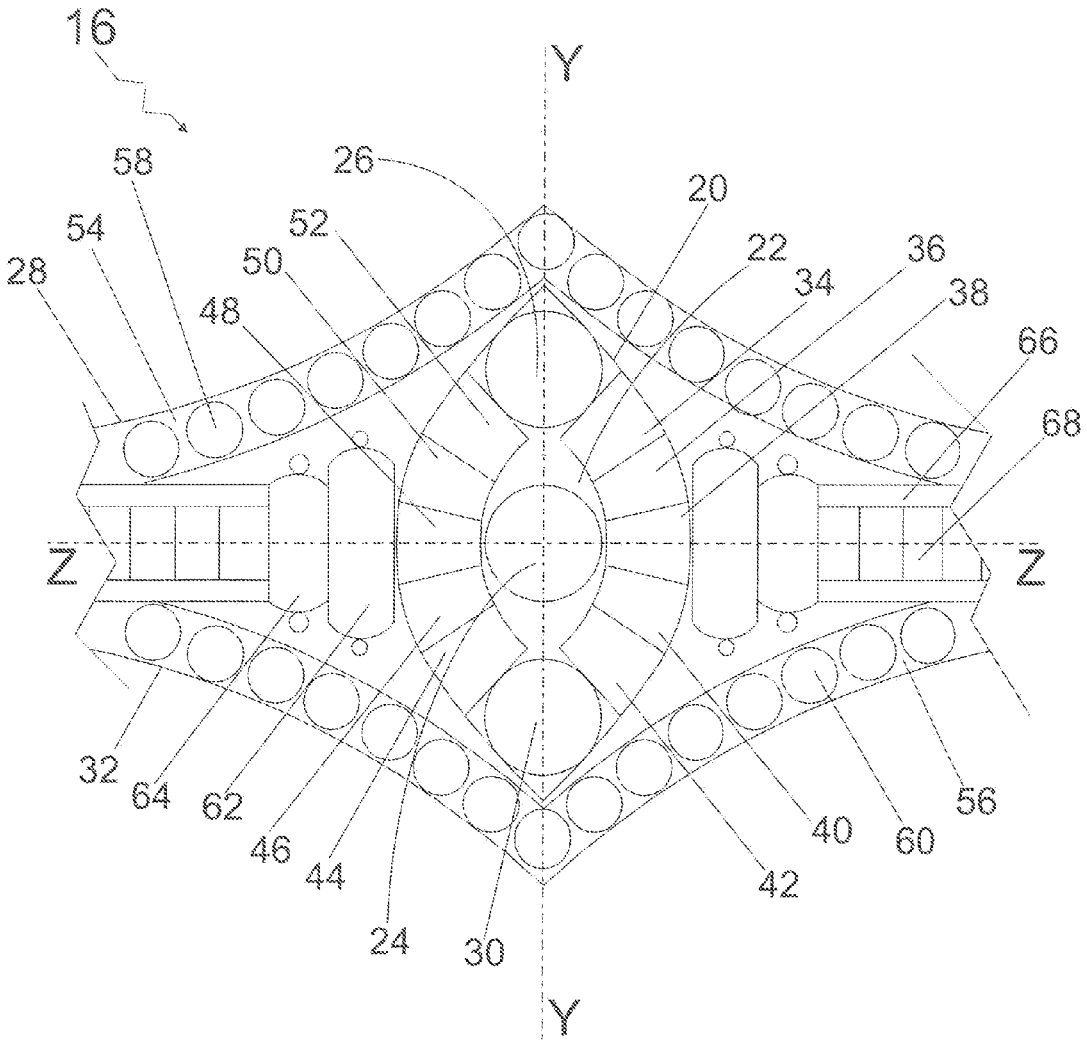
FIG. 2 is an enlarged top view of a head portion of the ring setting of FIG. 1 showing a preferred embodiment of a channel structure.

Referring initially to FIGS. 1 and 2, a jewelry ring 10 is shown that includes an inner rim member 12 and an outer rim member 14 that are bilaterally positioned along a central vertical axis-X and preferably define a head portion 16 and base portion 18. In this one preferred embodiment, the rim members 12, 14 have an off-centered orientation along axis-X that facilitate head portion 16 to have a relatively larger thickness than base portion 18. However, it is understood that rim members 12, 14 can have a common-centered orientation in other alternative embodiments. The inner rim 12 defines a circular boundary of hollow space within ring 10 that is preferably adapted to define a finger size of ring 10.

Head portion 16 is preferably located over upper portion of outer rim 14 and extends over half of the perimeter of rim 14. Base portion 18 is preferably defined over lower portion of rim 14. It is understood here that the orientation of portions 16, 18 may substantially vary in other alternative embodiments. Head portion 16 defines at least one channel structure that includes at least one indentation adapted to be positioned with a plurality of multiple shaped diamonds in a juxtaposition arrangement to form a clustered Diamond Head that creates an illusion of a big diamond to a normal observer.

In this one preferred embodiment, head portion 16 includes a first channel structure 20 that has a Marquise shaped indentation 22 configured to include a plurality of round cut and baguette diamonds/stones in a perfectly flush arrangement through an invisible setting means. The invisible setting means mounts diamonds/stones within indentation 22 by remaining invisible to a normal observer. The invisible setting means is a metal structure concealed underneath the stones/diamonds to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

First channel structure 20 has a center that is aligned along the central vertical axis-X that is positioned with a first round cut diamond 24. The channel structure 20 includes a second round cut diamond 26 that is positioned in the proximity of a first side edge 28 of structure 20. The channel structure 20 includes a third round cut diamond 30 that is positioned in the proximity of a second side edge 32 of structure 20. Diamonds/stones 24, 26 and 30 have their centers aligned along a single horizontal axis-Y that is substantially perpendicular to the central vertical axis-X.

The channel structure 20 includes a plurality of baguette diamonds that are adapted to surround round cut diamonds 22, 24 and 30. In this one preferred embodiment, channel structure 20 includes a first baguette diamond 34, a second baguette diamond 36, a third baguette diamond 38, a fourth baguette diamond 40, a fifth baguette diamond 42, a sixth baguette diamond 44, a seventh baguette diamond 46, an eighth baguette diamond 48, a ninth baguette diamond 50 and a tenth baguette diamond 52 that are positioned in juxtaposition with each other. It is understood here that the quantity of baguette diamonds may vary in other alternative embodiments. The juxtaposition arrangement of round 3 cut diamonds 24, 26, 30 and baguette diamonds 34-52 altogether form a clustered head that creates an illusion of a big marquise shaped Diamond to the normal observer.

The head portion 16 includes a second channel structure 54 and a third channel structure 56 that are respectively aligned along first side edge 28 and second side edge 32. The channel structures 54 and 56 are respectively identically positioned on either sides of a central horizontal axis-Z that is substantially perpendicular to the axis-Y. The channel structures 54, 56 in this one preferred embodiment respectively define indentations that are respectively configured to be mounted with a respective row of round diamonds/stones 58, 60 using a setting means. The diamonds 58, 60 are set in juxtaposition within respective indentations to represent a continuous uninterrupted diamond surface along edges 28, 32. The setting means in this one preferred embodiment is a bezel setting. However, it is understood that other setting means such as burnish setting, flush setting and pave setting can be used in other alternative embodiments.

The head portion 16 includes a first pair of baguette diamonds/stones 62 and a second pair of baguette diamonds 64 that are bilaterally positioned along the axis-Y and preferably have their centers located on the central horizontal axis-Z. The stones 62, 64 are preferably positioned on head portion using a prong setting means wherein the prong setting includes at least four prongs to hold stones 62, 64 in place, however, it is understood that other setting means such as a bezel setting or pave setting means can be used in other alternative embodiments of ring 10.

The head portion in this one preferred embodiment also includes a pair of fourth channel structures 66 bilaterally positioned along the axis-Y. Each of the channel structures 66 preferably includes a continuous row of a plurality of baguette cut diamonds 68. The diamonds 68 preferably have their centers located along the central horizontal axis-Z. The diamonds 68 are arranged in juxtaposition to create an illusion of a continuous, uninterrupted surface along a center of head portion 16.

Figure 3:
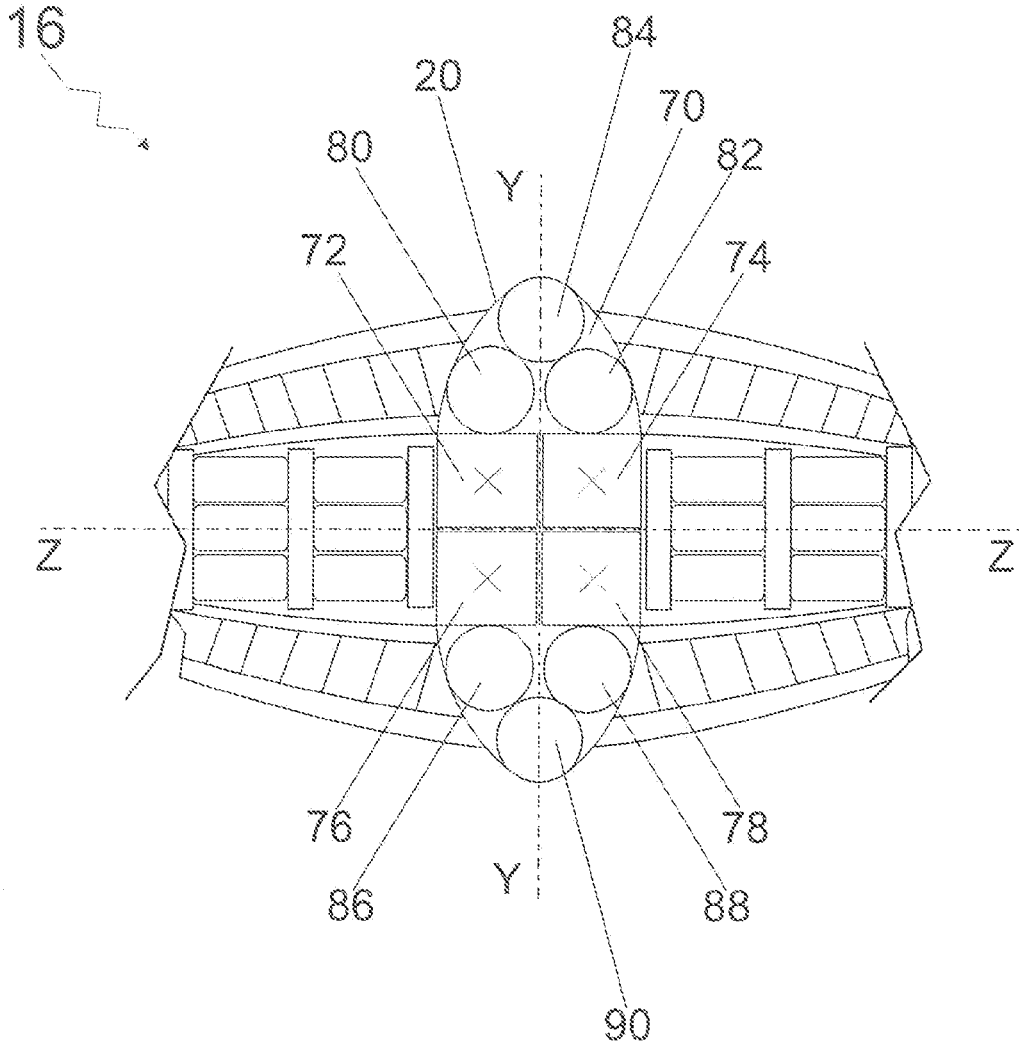
FIG. 3 is an enlarged top view of the head portion of the ring setting of FIG. 1 showing an alternative embodiment of the channel structure.

Referring to FIG. 3, an alternative embodiment of Marquise shaped composite head portion 16 is shown wherein first channeled structure 20 includes a Marquise shaped indentation 70 configured to include a plurality princess-cut and round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, indentation 70 includes a first princess-cut diamond 72, a second princess-cut diamond 74, a third princess-cut diamond 76 and a fourth princess-cut diamond 78. Diamonds 72, 74 are preferably located on one side of the axis-Z and diamonds 76, 78 are preferably located on the other side of the axis-Z. Diamonds 72, 76 are preferably located on one side of the axis-X and diamonds 74, 78 are located on the other side of the axis-X. Indentation 70 also includes a first round diamond 80, a second round diamond 82, a third round diamond 84, a fourth round diamond 86, a fifth round diamond 88 and a sixth round diamond 90. The first round diamond 80 is positioned in juxtaposition with first princess diamond 72. The second round diamond 82 is positioned in juxtaposition with second princess diamond 74. The third round diamond 84 is positioned in juxtaposition with diamonds 80, 82 and preferably positions over an upper apex portion of Marquise shaped indentation 70. The fourth round diamond 86 is positioned in juxtaposition with third princess cut diamond 76. The fifth round diamond 88 is positioned in juxtaposition with fourth princess cut diamond 78. The sixth round diamond 90 is positioned in juxtaposition with diamonds 88, 90 and preferably positions over a lower apex portion of indentation 70. The juxtaposition arrangement of princess cut diamonds 72, 74, 76 and 78 and round diamonds 80, 82, 84, 86, 88, 90 altogether form a clustered composite head that creates an illusion of a big marquise shaped Diamond to the normal observer.

Figure 4:
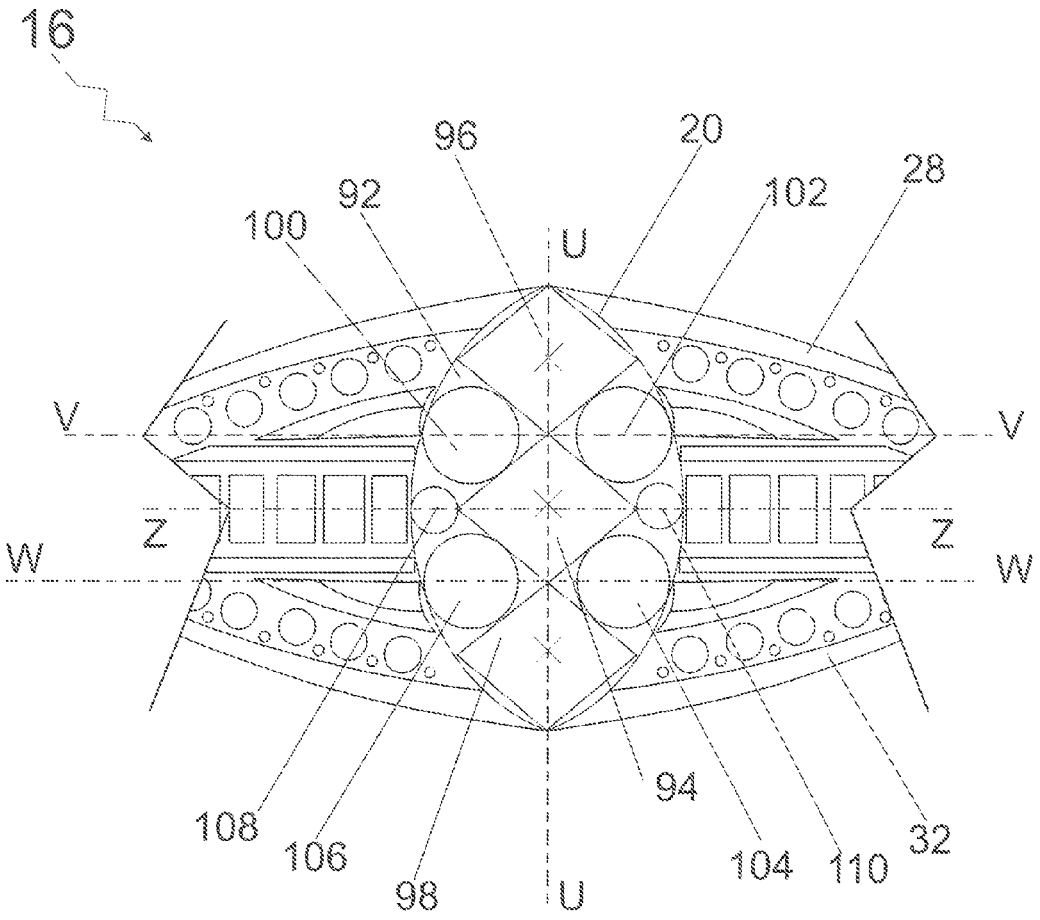
FIG. 4 is an enlarged top view of the head portion of the ring setting of FIG. 1 showing an alternative embodiment of the channel structure.

Referring to FIG. 4, an alternative embodiment of Marquise shaped composite head portion 16 is shown wherein first channeled structure 20 includes a Marquise shaped indentation 92 configured to include a plurality princess-cut, large round cut and small round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, first channel structure 20 has an indentation 92 that includes a first princess-cut diamond 94, a second princess-cut diamond 96, and a third princess-cut diamond 98. First princess-cut diamond 94 is positioned at a center of first channel structure 20 and is aligned along the central horizontal axis-Z. The second princess cut diamond 96 is positioned in the proximity of first side edge 28 of structure 20. The third princess cut diamond 98 is positioned in the proximity of second side edge 32 of structure 20. Diamonds/stones 94, 96 and 98 have their centers aligned along a single axis-W that is substantially perpendicular to the axis-Z.

The indentation 92 includes a first large round cut diamond 100, a second large round cut diamond 102, a third large round cut diamond 104 and a fourth large round cut diamond 106. The first and second round diamonds 100, 102 are preferably positioned along an axis-V that passes through an intersection surface of diamonds 94, 96. The third and fourth round diamonds 104, 106 are preferably positioned along an axis-W that passes through an intersection surface of diamonds 94, 98. The indentation 92 includes a first small round stone 108 and a second small round stone 110 that are substantially aligned along the axis-Z and preferably positioned along the corner points of first princess cut diamond 94.

Princess cut diamonds 94, 96, 98, four large round diamonds 100, 102, 104, 106 and small round cut diamonds 108, 110 altogether form a clustered composite head that creates an illusion of a big marquise shaped Diamond to the normal observer.

Figure 5:
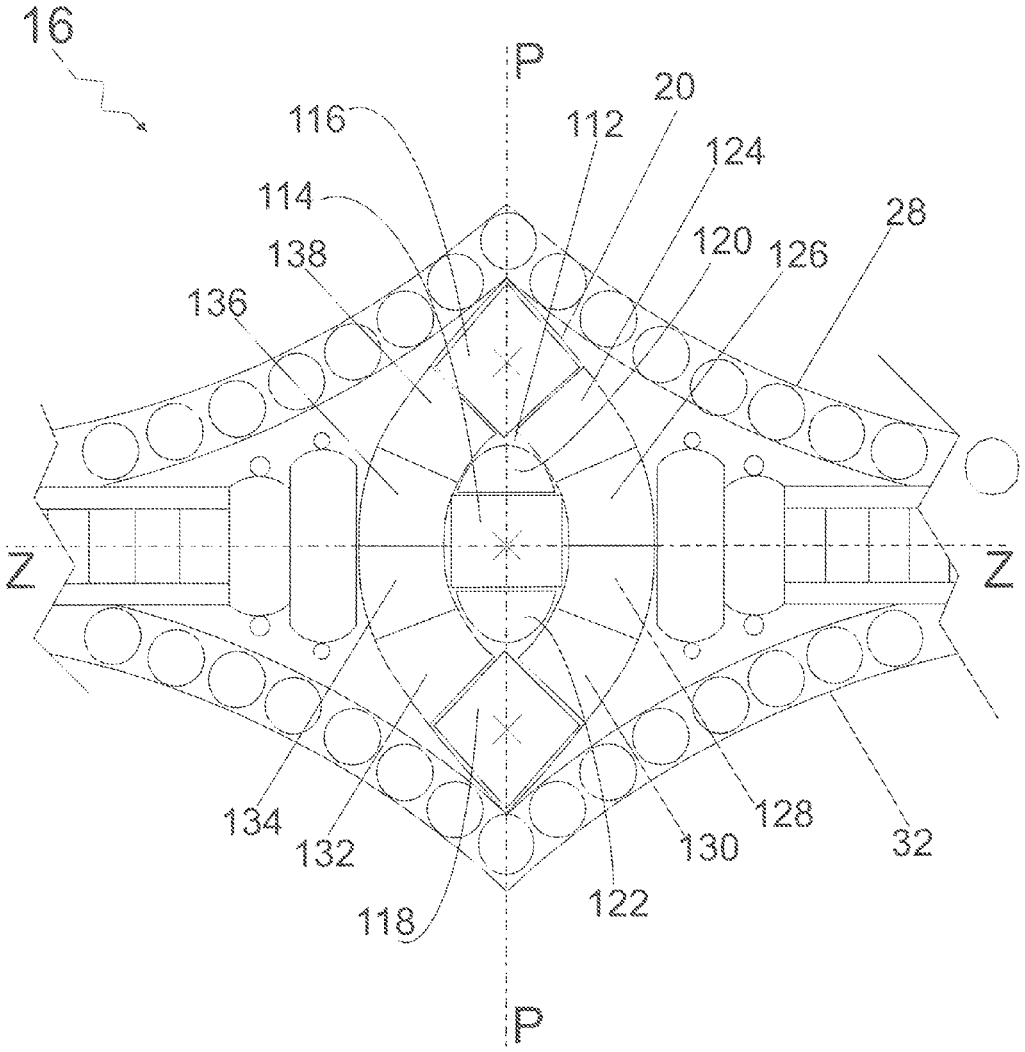
FIG. 5 is an enlarged top view of the head portion of the ring setting of FIG. 1 showing an alternative embodiment of the channel structure.

Referring to FIG. 5, an alternative embodiment of Marquise shaped composite head portion 16 is shown wherein first channeled structure 20 includes a Marquise shaped indentation 112 configured to include a plurality princess-cut, baguette cut and half round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, indentation 112 of first channel structure 20 includes a first princess-cut diamond 114, a second princess-cut diamond 116, and a third princess-cut diamond 118. First princess-cut diamond 114 is positioned at a center of first channel structure 20 and is aligned along the central horizontal axis-Z. The second princess cut diamond 116 is positioned in the proximity of first side edge 28 of structure 20. The third princess cut diamond 118 is positioned in the proximity of second side edge 32 of structure 20. Diamonds/stones 114, 116 and 118 have their centers aligned along a single axis-P that is substantially perpendicular to the axis-Z.

The indentation 112 includes a first half round cut diamond 120, a second half round cut diamond 122. The first half round diamond 120 is preferably positioned between the first and second princess-cut diamonds 114,116 along the axis-P. The second half round diamond 122 is preferably positioned between first and third princess-cut diamonds 114,118 along the axis-P.

The indentation 112 includes a first baguette diamond 124, a second baguette diamond 126, a third baguette diamond 128, a fourth baguette diamond 130, a fifth baguette diamond 132, a sixth baguette diamond 134, a seventh baguette diamond 136, and an eighth baguette diamond 138 that are positioned in juxtaposition with each other and preferably surround the first princess cut stone 114 and half round stones 120, 122. It is understood here that the quantity of baguette diamonds may vary in other alternative embodiments.

The princess cut diamonds 114, 116, 118, the half round diamonds 120, 122 and the baguette diamonds 124-138 altogether form a clustered composite head that creates an illusion of a big marquise shaped Diamond to the normal observer.

Figure 6:
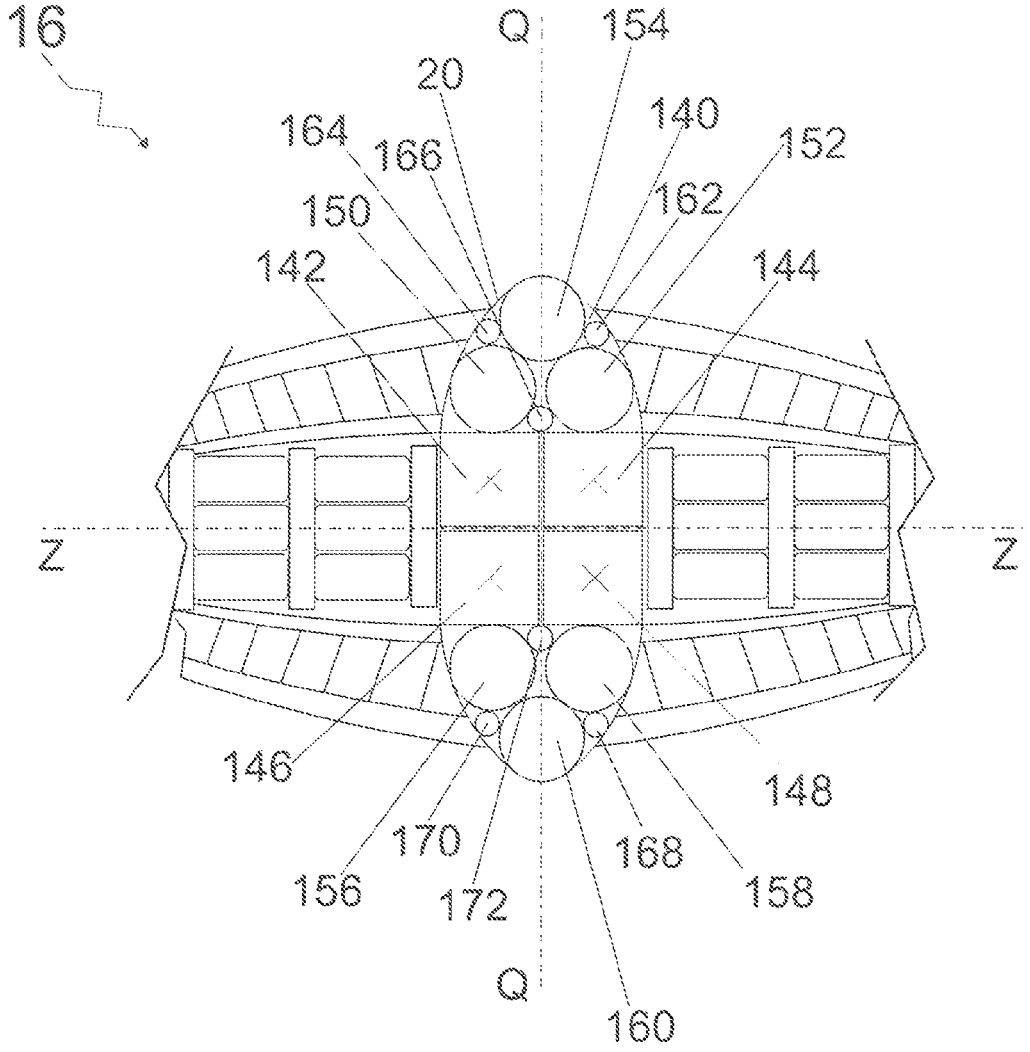
FIG. 6 is an enlarged top view of the head portion of the ring setting of FIG. 1 showing an alternative embodiment of the channel structure.

Referring to FIG. 6, an alternative embodiment of Marquise shaped composite head portion 16 is shown wherein first channeled structure 20 includes a Marquise shaped indentation 140 configured to include a plurality princess-cut and round-cut diamonds/stones in a perfectly flush arrangement against each other to compositely create a big illusion of a Marquise shaped diamond head.

Indentation 140 includes a first princess-cut diamond 142, a second princess-cut diamond 144, a third princess-cut diamond 146 and a fourth princess-cut diamond 148. Diamonds 142, 144 are preferably located on one side of the central axis-Z and diamonds 146, 148 are preferably located on the other side of the axis-Z. Diamonds 142, 146 are preferably located on one side of an axis-Q and diamonds 144, 148 are preferably located on the other side of the axis-Q. The axis-Q is substantially perpendicular to the axis-Z.

Indentation 140 also includes a first larger round diamond 150, a second larger round diamond 152, a third larger round diamond 154, a fourth larger round diamond 156, a fifth larger round diamond 158 and a sixth larger round diamond 160. The first larger round diamond 150 is positioned in juxtaposition with first princess diamond 142. The second larger round diamond 152 is positioned in juxtaposition with second princess diamond 144. The third larger round diamond 154 is positioned in juxtaposition with diamonds 150, 152 and preferably positions over an upper apex portion of Marquise shaped indentation 140. The fourth larger round diamond 156 is positioned in juxtaposition with third princess cut diamond 146. The fifth larger round diamond 158 is positioned in juxtaposition with fourth princess cut diamond 148. The sixth larger round diamond 160 is positioned in juxtaposition with diamonds 156, 158 and preferably positions over a lower apex portion of indentation 140.

Indentation 140 includes a first smaller round diamond 162, a second smaller round diamond 164, a third smaller round diamond 166, a fourth smaller round diamond 168, a fifth smaller round diamond 170 and a sixth smaller round diamond 172. The first smaller round diamond 162 is preferably positioned between the larger round diamonds 152, 154. The second smaller round diamond 164 is preferably positioned between the larger round diamonds 150, 154. The third smaller round diamond 166 is preferably positioned between the larger round diamonds 150, 152. The fourth smaller round diamond 168 is preferably positioned between the larger round diamonds 158, 160. The fifth smaller round diamond 170 is preferably positioned between larger round diamonds 156, 160. The sixth smaller round diamond 172 is preferably positioned between larger round diamonds 156, 158.

The juxtaposition arrangement of princess cut diamonds 142-148, larger round diamonds 150-160 and smaller round diamonds 162-172 altogether form a clustered composite head that creates an illusion of a big marquise shaped Diamond to the normal observer.

Figure 7:
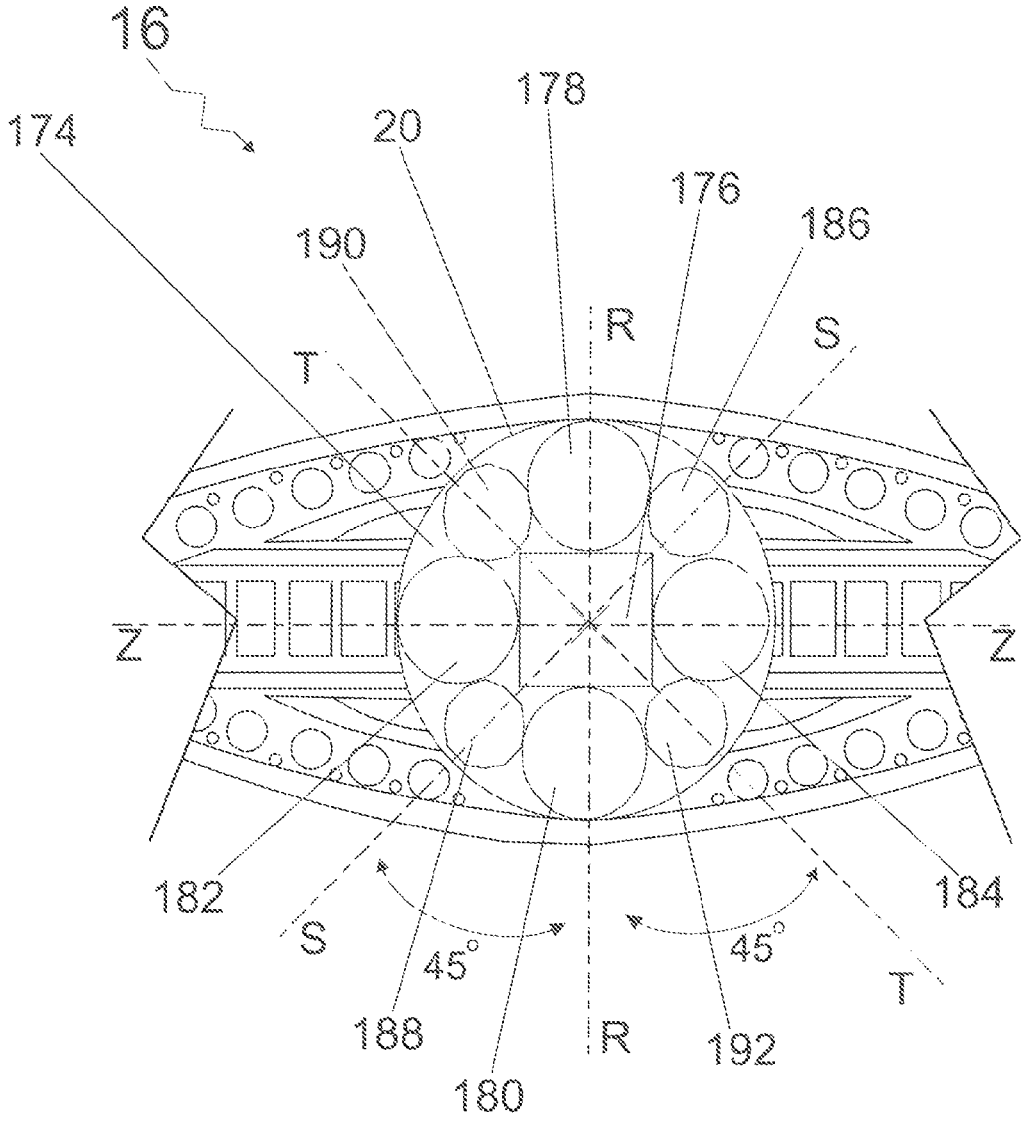
FIG. 7 is an enlarged top view of the head portion of the ring setting of FIG. 1 showing an alternative embodiment of the channel structure.

Referring to FIG. 7, an alternative embodiment of head section 16 is shown wherein the first channel structure 20 of head portion 16 is of circular shape and includes a circular shaped indentation 174 that is configured to include a plurality of small round cut, large round cut and princess cut diamonds/stones in a perfectly flush arrangement through an invisible setting means. The invisible setting means mounts diamonds/stones within indentation 174 by remaining invisible to a normal observer. The invisible setting is a metal structure concealed underneath the stones/diamonds to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

Indentation 174 includes a princess cut diamond 176 that is preferably centrally positioned along the structure 20 such that diamond 176 has a center located along the central horizontal axis-Z. The princess cut diamond 176 is surrounded by a plurality of small round cut and large round cut diamonds. In this one preferred embodiment the indentation 20 is positioned with four large round diamonds 178, 180, 182, 184 and four small round diamonds 186, 188, 190, 192. However, it is understood that the quantity and size of small and large round cut diamonds may vary substantially in other alternative embodiments. The large round cut diamonds 178, 180 have their centers located along a single axis-R that is substantially perpendicular to the axis-Z. The large round cut diamonds 182, 184 have their centers located along the central horizontal axis-Z. The small round cut diamond 186 is positioned between two large cut diamonds 178, 184. The small round cut diamond 188 is positioned between two large cut diamonds 180, 182. The small round cut diamonds 186, 188 have their centers located along a single axis-S that makes an angle of 45.degree. with central axis-Z. The small round cut diamond 190 is positioned between two large cut diamonds 178, 182. The small round cut diamond 192 is positioned between two large cut diamonds 180, 184. The small round cut diamonds 190, 192 have their centers located along a single axis-T that makes an angle of 45.degree. with central axis-Z.

The juxtaposition arrangement of larger round cut diamonds 178-184, smaller round cut diamonds 186-192 and princess cut diamond 176 altogether form a clustered composite head that creates an illusion of a big round shaped Diamond to the normal observer.

Figure 8:
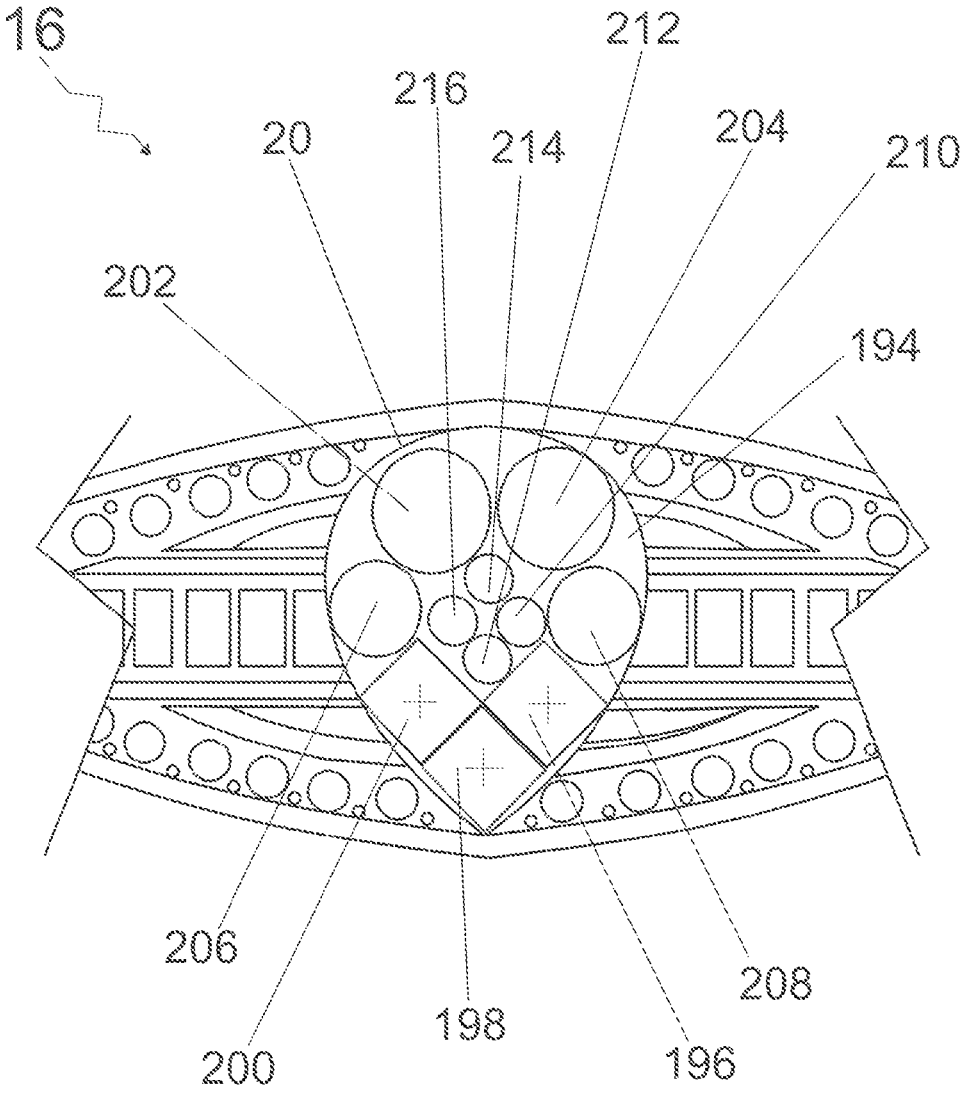
FIG. 8 is an enlarged top view of the head portion of the ring setting of FIG. 1 showing an alternative embodiment of the channel structure.

Referring to FIG. 8, an alternative embodiment of head 16 is shown wherein channel structure 20 has a pear shaped indentation adapted to be positioned with a plurality of round cut and princess cut diamonds to form a composite Diamond Head cluster adapted to create an illusion of a big pear shaped diamond. In this one embodiment the structure 20 has a pear shaped indentation 194 that includes a first princess cut diamond 196, a second princess cut diamond

198, a third princess cut diamond 200, a first large round cut diamond 202, a second large round cut diamond 204, a first medium round cut diamond 206, a second medium round cut diamond 208, a first small round cut diamond 210, a second small round cut diamond 212, a third small round cut diamond 214 and a fourth small round cut diamond 216.

The princess cut diamonds 196-200, large round cut diamonds 202-204, medium round cut diamonds 206-208, and small round cut diamonds 210-216 are positioned to have juxtaposition arrangement to form a clustered composite head that creates an illusion of a big pear shaped Diamond to the normal observer. However, it is understood here that number and dimensions of the princess cut diamond may vary in other alternative embodiments.

The embodiments of the invention shown and discussed herein are merely illustrative of modes of application of the present invention. Reference to details in this discussion is not intended to limit the scope of the claims to these details, or to the figures used to illustrate the invention.

The invention claimed is:

1. A jewelry device comprising: a base portion; a head portion, the head portion having a first thickness that is relatively larger than a second thickness of the base portion, the first thickness and the second thickness being defined by an inner rim and an outer rim; and a structure, the structure being incorporated into the first thickness of the head portion with the structure being between the inner rim and the outer rim of the head portion, the structure having an outer circumference in a marquise shape, the structure including an invisible setting located within an indentation of the structure, the invisible setting mounting jewelry stones, the jewelry stones including at least three princess-cut stones and at least six round-cut stones within the indentation of the structure in such a way that the jewelry stones appear to be a continuous, uninterrupted surface thereby creating an illusion of a large stone in the marquise shape, wherein (1) a first of the at least three princess-cut stones is positioned at a center of the structure and is aligned along a first axis, (2) a second of the at least three princess-cut stones is positioned in a proximity of a first tapered point of the structure, (3) a third, of the at least three princess-cut stories is positioned in a proximity of a second tapered point of the structure, (4) the at least three princess-cut stones have their centers aligned along a second axis that is substantially perpendicular to the first axis and (5) the at least six round-cut stones being in near contact with the outer circumference of the structure and an edge of the first of the at least three princess-cut stones.

2. The jewelry device of claim 1 wherein the invisible setting is formed by a metal structure that is concealed underneath the jewelry stones.

* * * * *